United States Patent [19]

Osborn

[11] 4,173,045

[45] Nov. 6, 1979

[54] COMBINATION SOFA AND BED

[76] Inventor: L. Earl Osborn, 25 W. 665 Elmwood Dr., Wheaton, Ill. 60187

[21] Appl. No.: 805,471

[22] Filed: Jun. 10, 1977

[51] Int. Cl.[2] ..... A47C 17/04

[52] U.S. Cl. ..... 5/12 R; 5/465

[58] Field of Search ..... 5/12 R, 357, 352, 344

[56] References Cited

U.S. PATENT DOCUMENTS

| | | | |
|---|---|---|---|
| 2,247,667 | 7/1941 | Rosberger | 5/357 |
| 2,368,938 | 2/1945 | McKay | 5/12 R |
| 3,555,581 | 1/1971 | Friant | 5/357 A |
| 3,736,023 | 5/1973 | Lyons | 5/357 R |
| 3,902,759 | 9/1975 | Monteforte | 5/357 R |

FOREIGN PATENT DOCUMENTS

| | | | |
|---|---|---|---|
| 546541 | 4/1956 | Belgium | 5/357 |
| 2136598 | 2/1973 | Fed. Rep. of Germany | 5/357 R |
| 586532 | 4/1977 | Switzerland | 5/12 R |

*Primary Examiner*—Philip C. Kannan
*Attorney, Agent, or Firm*—Edmond T. Patnaude

[57] ABSTRACT

A sofa is made up of a pair of hingedly connected cushion members hingedly connected to a pair of hingedly connected bolster members which when folded together provide a sofa having a cushioned seat and a cushioned back rest and when folded out provides a standard length mattress.

4 Claims, 5 Drawing Figures

COMBINATION SOFA AND BED

The present invention relates in general to a sofa which is convertible to a bed, and it relates in particular to such a sofa which is adaptable for use in van type vehicles and the like and which provides a comfortable sofa as well as a comfortable bed.

BACKGROUND OF THE INVENTION

Sofas which are convertible to beds are well known in the art. One type of convertible sofa is known as a studio couch and utilizes a plurality of separate pillows or bolsters as a back rest. Studio couches provide a comfortable bed but leave much to be desired as a sofa. Another type of convertible sofa utilizes a back rest which is pivoted to the seat to provide a bed. The bed has the disadvantage that there is a seam or depression which runs from top to bottom and this depression is not centered nor is either side of the depression sufficiently wide for sleeping comfort. There are convertible sofas which provide both a comfortable sofa and a comfortable bed, but these sofas are relatively expensive.

There is a need, therefore, for a low cost piece of convertible furniture which provides both a comfortable seat or sofa and a comfortable bed. Applications for such furniture are in vans, campers, house boats as well, of course, as in any living quarters where space is at a premium.

SUMMARY OF THE INVENTION

Briefly, in accordance with the present invention a combination sofa and bed comprises a pair of cushion members and a two-part bolster. The two bolster members are hingedly connected together and the cushion members are hingedly connected together. When the cushion members are positioned one on the other they provide the seat portion of a sofa with the bolster providing the back rest. When the cushion members are folded out and the bolster members are also folded out and positioned at one end of the two cushion members there is provided a bed of standard length. The bolster can also be folded out and positioned at one end of the cushion members to provide a pillow.

GENERAL DESCRIPTION OF THE DRAWING

A better understanding of the present invention may be had from a reading of the following detailed description taken in connection with the accompanying drawing wherein.

DETAILED DESCRIPTION OF THE INVENTION

Figure 1:
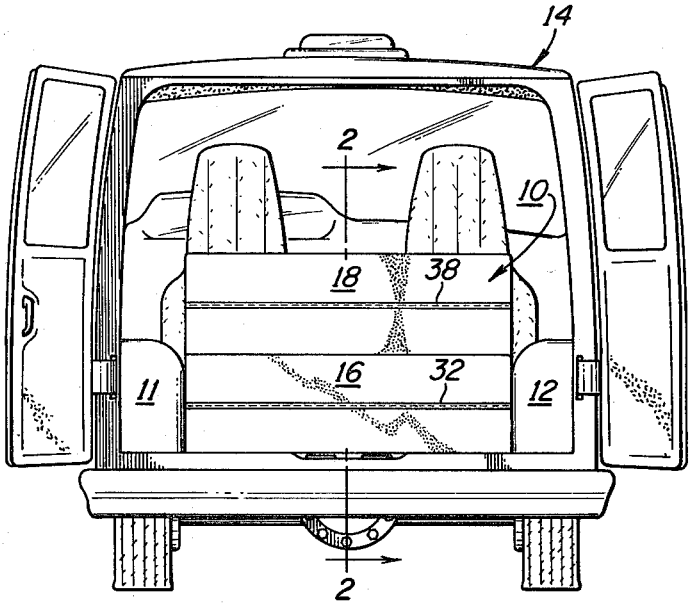
FIG. 1 is a rear view of a van in which a piece of convertible furniture embodying the present invention is disposed.

Referring to FIG. 1, there is shown a sofa type piece of furniture 10 located between the wheel wells 11 and 12 in a van type vehicle 14. The sofa 10 is made up of a composite seat member 16 and a composite back member or bolster 18. As illustrated in FIG. 1 the sofa 10 faces towards the rear of the van wherefore persons sitting on the sofa 10 would face toward the rear of the van. The back side of the sofa 10 is toward the front of the van and may be positioned directly against the rear of the front seats. However, the sofa 10 can be positioned with the rear toward the back of the van, or it can be positioned sidewise in front of the wheel wells with the back of the sofa disposed against the side wall of the van.

Figure 2:
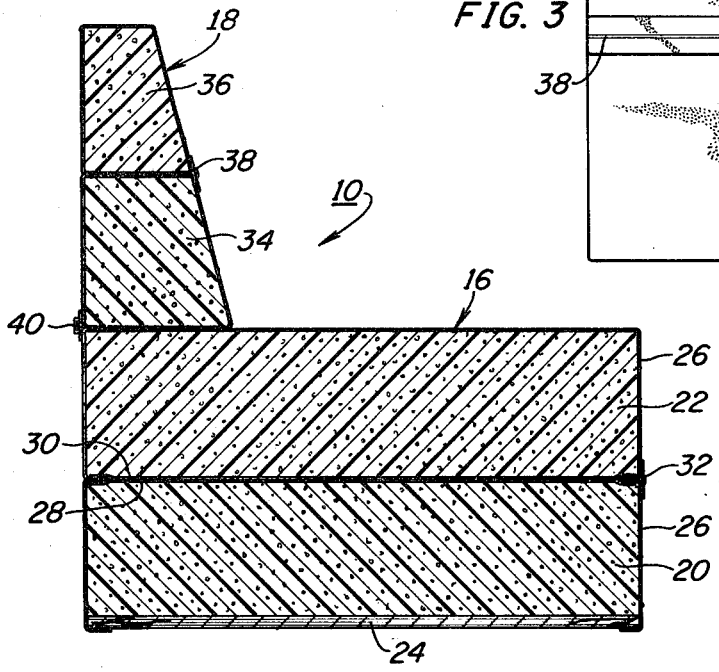
FIG. 2 is a cross-sectional elevational view of the piece of furniture shown in FIG. 1 and taken along the line 2—2 thereof.
Figure 3:
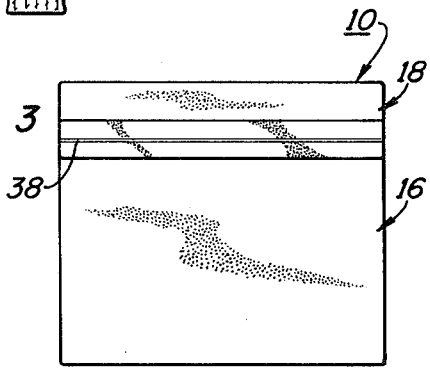
FIG. 3 is a top view, reduced in size, of the furniture piece shown in FIG. 2.

With further reference to FIGS. 2 and 3 it may be seen that the seat portion 16 comprises a lower member 20 which is rectangular in horizontal cross section and an upper cushion member 22 which is adapted to rest on the lower cushion member 20 when the piece of furniture 10 is used as a sofa. The lower cushion member 20 is also rectangular in horizontal cross section and may include a rigid base member or frame 24 suitably formed of wood or other rigid material. The cushion member 20 is, however, primarily a block of a plastic foam such as urethane foam. The upper cushion member is simply a block of foam. The cushion members 20 and 22 are covered with an upholstery type fabric 26. However, as explained in greater detail hereinafter, the upper horizontal surface of the lower cushion member 20 and the lower horizontal surface of the upper cushion member 22 are respectively covered with sheets 28 and 30 of mattress ticking or other suitable bedding material.

The upper foreward edge of the lower cushion member 20 is hingedly attached to the lower foreward edge of the upper cushion member 22 by means of a strip 32 of a flexible material such, for example, as cloth. The lower and upper edges of the strip 32 are attached as by sewing or gluing to the adjacent front faces of the upholstery on the lower and upper cushion members.

The back rest of the sofa 10 is provided by a two piece composite bolster member 18 formed by a lower bolster member 34 and an upper bolster member 36. The foreward faces of the bolster members 34 and 36 are coplanar when the upper bolster member 36 is positioned on top of the lower bolster member 34. The upper foreward edge of the lower bolster member 34 is connected to the lower foreward edge of the upper bolster member 36 by means of a hinge 38 which is preferably of the same construction as the hinge 32. In order to provide a comfortable sloping back rest the foreward faces of the bolster members 34 and 36 slope rearwardly as best shown in FIG. 2.

The rear faces of the two cushion members 20 and 22 and the two bolster members 34 and 36 are coplanar when in the sofa position. A hinge 40 connects the upper rearward edge of the cushion member 22 to the lower rearward edge of the lower bolster member 34. The hinge 40 extends throughout the full length of the associated bolster and cushion members and in a preferred embodiment of the present invention incorporates a zipper or other separable connector so that the entire bolster 18 may, if desired, be removed from the upper cushion member 22. The reason for this is explained in greater detail hereinafter.

Figure 4:
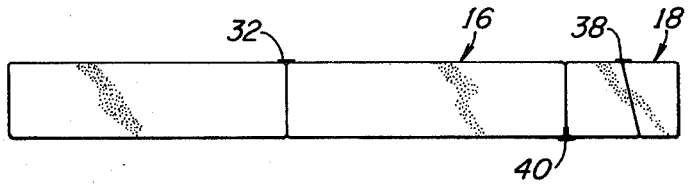
FIG. 4 is a schematic side view showing the furniture piece of FIG. 2 folded out in one way to form a bed.

In order to use the piece of furniture 10 as a bed, the upper cushion member 22 is folded clockwise, as shown in FIG. 2, into alignment with the lower cushion member 20, the upper bolster member 36 is folded clockwise so that its normal front face rests against the front face of the bolster member 34 and the composite bolster members are then swung upwardly about the pivot axis of the hinge 40 into alignment with the cushion members 20 and 22. The resulting device is a bed or mattress as illustrated in FIG. 4. The height of the cushion members and the two bolster members are all the same and are preferably about eight inches. Moreover, because the hinges 32, 38 and 40 are attached to the outside surfaces which are folded together in the mattress configuration, they do not protrude upwardly where they would provide a source of discomfort for the user.

Preferably, the cushions have a front to rear dimension of thirty inches and the composite length of the front to rear lower dimension of the bolster member 34 and the front to rear upper dimension of the bolster member 36 equals twelve inches. Consequently, when the pieces are folded out and layed flat as shown in FIG. 4 the total length of the bed is seventy-two inches. This is a standard length bed and, therefore, standard length sheets and blankets may be used with the bed. If the piece of furniture 10 is to be used in a van, then the width dimensions of the cushion members and the bolster members should be about forty eight inches, the usual distance between the wheel wells in a van. Also, by using this width dimension the piece of furniture 10 may be placed sideways in a van forwardly of the wheel wells if desired.

Figure 5:
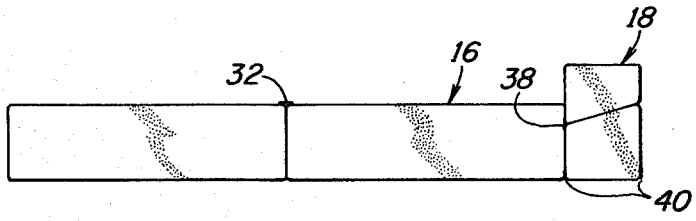
FIG. 5 is a schematic side view showing the furniture piece of FIG. 2 folded out in another way to form a bed.

Should it be desired to use the bolster 18 as a pillow, the entire bolster may be separated from the upper cushion member 22 by means of the zipper or the like 40 and then positioned as illustrated in FIG. 5. If the height of the cushion members is eight inches and the combined length of the laid out flat bolster member is twelve inches, then a pillow having a height four inches above the level of the base portion of the bed will be provided.

An advantageous feature of the furniture piece 10 of the present invention is that when the cushion members are folded flat out to provide a bed, the cushion members 20 and 22 are held together by the hinge 32 provided just below the top surface of the bed, and the cushions do not, therefore, tend to pull apart as is common in beds made up of multiple cushions. Also, there is no longitudinal seam or the like extending from one end of the bed to the other. The lateral seam does not provide any noticeable discomfort.

The outer surfaces of the cushion members 20 and 22 are, as indicated above, covered with a suitable upholstery material and the bolster members 34 and 36 may be covered with the same upholstery material. The ticking surfaces 28 and 30 are provided, however, since the usual upholstery material is not sufficiently moisture absorbent and porous to be comfortable when used as a mattress surface. Inasmuch as the bolster is generally at the foot of the bed, it can be entirely covered with the upholstery fabric without providing any noticeable discomfort. However, if desired the top surface of the bolster member 34 and bottom surface of the bolster member 36 can also be covered with ticking material.

In order to provide a comfortable cushioned type seat it is known that the front to rear seat dimension should be preferably between about twenty inches and twenty-three inches. Any longer or shorter seat surface is uncomfortable to most people. Therefore, by designing the bolster members 34 and 36 so that the front to rear dimension of the bottom surface of the bolster surface 34 is eight inches and by using cushions having a length from front to rear of thirty inches, it will be found that the seat length from front to rear is twenty-two inches, a comfortable length. Also, by using a relatively soft material for the foam in the bolster members 34 and 36 and the cushions 20 and 22, a rear back surface having the slope extending from eight inches to four inches in height of sixteen inches is found to be quite comfortable. When this bolster is folded out it has the desired length of twelve inches which combines with the two thirty inch cushions to provide a bed whose length is seventy-two inches.

Where the piece of furniture 10 is to be used in a van, means, such as tie down straps, suction cups or the like may be used to attach the base frame of the lower cushion member 20 to the floor of the van. For use in the home or the like, this is unnecessary since the piece of furniture will not readily move on a stationary floor.

While the present invention has been described in connection with particular embodiments thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed is:

1. A combination sofa and bed, comprising a first cushion member, a second cushion member adapted to rest on said first cushion member, said cushion members having horizontal top and bottom surfaces and substantially planar and vertical front surfaces, first hinge means interconnecting the forward upper edge of said first cushion member with the forward bottom edge of said second cushion member, a first bolster member adapted to rest on said second cushion member, a second bolster member adapted to rest on said first bolster member with the front surfaces of said bolster members being coplanar, second hinge means interconnecting the forward upper edge of said first bolster member with the forward lower edge of said second bolster member, said cushion members and said bolster members all having substantially the same height, and third hinge means interconnecting the upper rear edge of said second cushion member with the rear bottom edge of said first bolster member, and said third hinge means including first and second mutually disconnectable flexible strips to permit separation of said bolster members from said cushion members.

2. A combination sofa and bed according to claim 12 comprising a zipper interconnecting said first and second flexible strips.

3. An article of furniture convertible between a sofa configuration and a bed configuration comprising a first rectangular cushion member having a length dimension corresponding to the width of said sofa, a second rectangular cushion member resting on said first cushion member when said article is in the sofa configuration, said cushion members respectively having horizontal top and bottom surfaces and mutually coplanar front, rear and side surfaces when said combination is in said sofa configuration, first hinge means interconnecting the forward upper edge of said first cushion member with the forward lower edge of said second cushion member to permit said second cushion member to be swung forwardly to position the said front edges of said cushion members in juxtaposed relationship and the upper surfaces of said cushion members in mutually coplanar relationship, a first bolster member resting on the rear portion of said second cushion member when said combination is in said sofa configuration, a second bolster member resting on said first bolster member with the front surfaces of said bolster members being mutually coplanar and sloping rearwardly in an upward direction, when said article is in said sofa configuration, second hinge means interconnecting the forward upper edge of said first bolster member with the forward lower edge of said second bolster member, said cushion members and said bolster members all having the same height and length dimensions, and third hinge means interconnecting the upper rear edge of said second cushion member with the lower rear edge of said first bolster member, a separable connector incorporated in said third hinge means to permit said first and second bolster members to be separated from said second cushion member, whereby said first and second bolster members may be swung into positions in line with said first and second cushions to provide a rectangular bed having an entirely planar upper surface and a length equal to the sum of the front to rear dimensions of said cushion members, the front to rear dimension of the bottom surface of said first bolster member and the front to rear dimension of the top surface of second bolster member.

4. An article of furniture according to claim 3 wherein said first and second cushion members and said bolster members all have the same height, said cushion members have equal length and width dimensions of forty-eight inches and thirty inches respectively and the sum of the front to rear dimensions of the first and second cushion members, the bottom of said first bolster member and the top of said second bolster member being seventy-two inches.

* * * * *